United States Patent [19]

Bremer et al.

[11] 4,273,025

[45] Jun. 16, 1981

[54] BELT-ADVANCE MECHANISM FOR AN AUTOMATIC GAS-LOADING BELT-FEED WEAPON, ESPECIALLY A MACHINE GUN

[75] Inventors: Clemens Bremer; Lothar Post, both of Düsseldorf, Fed. Rep. of Germany

[73] Assignee: Rheinmetall GmbH, Düsseldorf, Fed. Rep. of Germany

[21] Appl. No.: 15,649

[22] Filed: Feb. 27, 1979

[30] Foreign Application Priority Data

Mar. 6, 1978 [DE] Fed. Rep. of Germany ..... 2809505

[51] Int. Cl.[3] ..... F41D 10/04

[52] U.S. Cl. ..... 89/33 CA; 89/193

[58] Field of Search ..... 89/33 BA, 33 BC, 33 CA, 89/193

[56] References Cited

U.S. PATENT DOCUMENTS 2,865,256 12/1958 Marsh ..... 89/191

3,999,461 12/1976 Johnson et al. ..... 89/33 CA

FOREIGN PATENT DOCUMENTS 1231594 12/1966 Fed. Rep. of Germany ..... 89/33 BA

*Primary Examiner*—Stephen C. Bentley

*Attorney, Agent, or Firm*—Montague & Ross

[57] ABSTRACT

A belt-advance system for a belt-fed gas-loading automatic weapon, e.g. a machine gun, revises the usual energy flow path by obtaining at its input side a gas-pressure pulse upon the firing of the weapon and providing an energy-storage unit functionally combined with a cylinder/gas-piston unit for transforming the pneumatic energy into mechanical energy for stepping the belt-advance ratchet pawl.

8 Claims, 5 Drawing Figures

BELT-ADVANCE MECHANISM FOR AN AUTOMATIC GAS-LOADING BELT-FEED WEAPON, ESPECIALLY A MACHINE GUN

FIELD OF THE INVENTION

The present invention relates to automatic weapons, such as machine guns and machine cannons, which are belt-fed and, more particularly, to a belt-advance mechanism for such a weapon.

BACKGROUND OF THE INVENTION

Modern automatic weapons over the full caliber range make use of a variety of mechanisms for feeding the cartridges into the breech of the weapon. Mention may be made, in this connection, of magazine feeders, turret feeders and belt feeders. Of concern to the present invention, however, are belt-feeding mechanisms for such automatic weapons.

In addition, mention may be made of the various ways in which the belt can be advanced, e.g. by the use of recoil energy or by gas power. It is an advancing system of the latter type with which the present invention is concerned.

In gas-powered belt-advancing mechanisms for belt-fed automatic weapons, such as machine guns, an energy-flow path can be provided which at its input side, is formed by a gas passage for tapping the high pressure of the gas propellant which drives the bullet or projectile from the barrel of the weapon upon the firing thereof.

The gas passage feeds a cylinder/gas-piston unit which converts the energy of the propellant gas (pneumatic energy) into mechanism energy, the output of the gas piston being applied to a ratchet pawl and a transport shaft for stepping the belt and aligning the next cartridge thereof with the breech or cartridge chamber.

A time-delay unit is provided in this energy-flow train in the form of a mechanical energy storage device, e.g. which can have springs compressible by the pneumatic energy.

The belts which are used in such automatic weapons generally are formed as a flexible element or with a plurality of articulated links and have spaced apart seats, e.g. in the form of clips, into which the respective cartridges can be pressed.

The gas-pressure loading utilizes the highly compressed propellant gas behind the projectile and branches a small fraction of the volume of this propellant gas from the barrel behind the projectile upon the firing thereof and before the projectile has fully escaped from the barrel of the weapon.

When such compressed gas is used to actuate accessories of the weapon, e.g. the cartridge-feed ratchet pawl and the belt-displacement shaft, care must be taken to bear in mind the mass of the belt and hence its inertia.

The problem is that the gas pressure pulse is only applied for a brief instant during each firing cycle.

Because of its inertia or mass of the belt, the latter responds to forces tending to advance the belt, especially if they are practically instantaneous by a retardation which applies considerable stress to the belt. These stresses may cause tearing of the belt.

In German Pat. No. 1,290,455 there is described a system which is intended to avoid this disadvantage. In this system, the gas pressure upon firing of the weapon is recovered as pneumatic energy and the pneumatic energy is, in turn, transformed into mechanical energy in a cylinder/gas-piston unit. The gas piston actuates in its working stroke a ratchet pawl which is provided with a restoring spring and the ratchet, in turn, stresses a plurality of spirally coiled, prestressed band-type coil springs which collectively form a stack serving as a force-storage device.

After the stored energy reaches a certain level, it is applied to a belt-feed mechanism, for example via a shaft.

This system has the advantage, because of the conversion of the gas pressure into mechanical energy which is stored, that the stored mechanical energy can effect the advance of the loading belt in a highly reproducible and reliable manner because mechanical energy can be recovered from storage over a fixed path and for a fixed interval fully reproducibly over many operating cycles. However, it has the disadvantage that the time required for stressing the energy-storage spring and recovering the energy from the mechanical storage is considerable and, if reduced or eliminated, could enable the advance of the belt more rapidly, i.e. allow the transmission of energy along the path from the rise of the pneumatic pressure (i.e. the generation of the energy pulse) to the actuations of the advancing mechanism for the belt to be shortened.

This is particularly important for automatic weapons which are to have a high fire power and hence a more rapid loading cadence and rounds per minute firing capability than lower fire-power weapons.

In addition, the increased length of the energy transmission train of necessity involves a number of mechanical components which increase the fabrication cost of the weapon, the maintenance operation required for it and the complexity with concomitant danger of decreased reliability. Another disadvantage of the longer energy train is, of course, the increased size and weight of the weapon.

In practice, it has been found that the storage spring systems of the earlier weapons require frequent checking to avoid malfunctioning due to settling.

Finally, a disadvantage of the earlier systems is a need for a large number of parts which tend to wear and must be replaced so that logistical problems can arise in the use of such weapons.

OBJECTS OF THE INVENTION

It is the principal object of the present invention to provide an improved belt-advance system for a belt-feed gas-loading automatic weapon whereby the aforedescribed disadvantages are avoided.

Another object of the invention is to reduce the length and complexity of the energy-flow train in a belt-advance system for a belt-feed gas-loading automatic weapon such as a machine gun or machine cannon.

Still another object of the invention is to provide an automatic weapon with improved fire power and hence loading cadence which has a reduced number of parts, by comparison with earlier systems, is more reliable, is less expensive, requires less maintenance and is less bulky.

It is also an object of the present invention to provide a belt-feed drive of the aforedescribed type which is more rapidly operating and of lower cost while being free from the disadvantages of the earlier systems.

SUMMARY OF THE INVENTION

These objects are attained, in accordance with the present invention, in a belt-advance system for an automatic belt-feed gas-loading gun, especially an automatic weapon such as a machine gun or a machine cannon, which is provided with an energy-flow path initiated at a passage communicating with the barrel of the weapon for receiving pneumatic energy in the form of a high pressure propulsion-gas pulse upon the firming of a round in the chamber of the weapon. The energy-flow path includes a cylinder/gas-piston unit for transforming the pneumatic energy of the propellant gas into mechanical energy and a ratchet mechanism connected to the belt-advance wheels or the like and whose member is restored to its initial position by a spring but which is activated by the mechanical energy to step the belt and bring the next round to be fired into alignment with the chamber.

According to the present invention, the energy storage device is constructed and arranged so as to store the gas or pneumatic energy (rather than the mechanical energy after transformation as in prior art systems) and is provided, in the energy-flow direction, ahead of the cylinder/gas-piston unit while being functionally integrated therewith.

The major advance resulting from the modification of the energy-flow path of the prior art, in accordance with the instant invention, is the significant simplification of this energy-flow path with the drastic reduction in the number of moving parts and elements of the belt-advance mechanism or system and the significant reduction in the mass which must be displaced to step the munitions belt.

According to a feature of the invention, the gas-energy storage device is integrated with the cylinder/-gas-piston unit in space as well as functionally, i.e. both can be provided in a common housing or mounting. It has also been found to be advantageous to maintain a connection between the belt-advance mechanism and the stepping ratchet during the entire working stroke of the latter.

It also has been found to be advantageous, moreover, to provide the energy-storage unit which includes a gas-storage chamber or reservoir which is provided with an inlet of defined flow cross section and volume such that a jump in the pressure $p_v$ ahead of the inlet over atmospheric pressure, a ratio $a=p_v/p_h$ is obtained which very rapidly becomes unity while with rapid fall of $p_v$ against the atmospheric pressure, the reciprocal ratio 1/a falls comparatively slowly to unity, $p_h$ representing the instantaneous pressure downstream of the inlet.

Advantageously, the flow cross section at the inlet upon a forward pressure differential across the inlet is greater than the flow cross section with the reverse pressure differential, i.e. a gradient in which the pressure behind the inlet is greater than that ahead of the inlet.

A bypass with fixed flow cross section can be provided to achieve the flow conditions mentioned above and can be provided in conjunction with a valve body which is shiftable into its open position by a pressure differential with the higher pressure in the upstream side of the inlet can be formed in the tap at which the gas pressure is supplied from the barrel of the weapon to the gas passage leading therefrom. In this case, of course, the volume of the gas passage is included in the volume of the gas storage compartment.

We have found it to be advantageous, moreover, to provide means for adjusting the capcity (volume) of the energy-storage compartment and for varying the effective volume of the energy-storage system as a whole.

The feeders of the invention discussed above permit considerable simplification of the belt-advance system for the automatic weapon.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
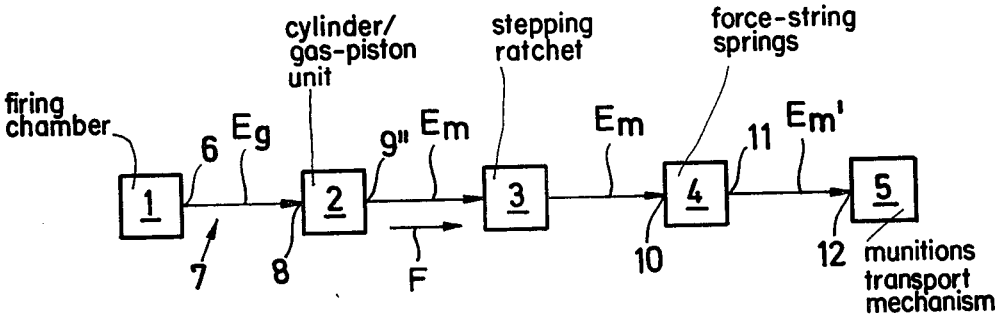
FIG. 1 (PRIOR ART)
FIG. 1 is an energy flow diagram illustrating the operation of a conventional belt-feed system, e.g. as described in the aforementioned German publication (prior art)

We have shown in FIG. 1 a state-of-the art energy-flow train in the most diagrammatic form, for the stepping of the munitions belt of an automatic weapon.

As illustrated in the aforementioned German patent, the weapon belt may be provided with clips in which respective rounds or cartridges are seated, the belt being passed over a sprocket wheel or the like which is stepped by the ratchet mechanicm for advancing the rounds one by one into alignment with the firing chamber of the weapon. For details with respect to the belt, the firing mechanism chamber and guide means for munitions belt, reference may be had to the aforementioned patent, the references cited therein and other art in the same international patent classification class and subclass. The details of the ratchet likewise are not a part of the invention and the ratchet may be the stepping pawl or lever used in the aforementioned patent.

However, FIG. 1 does show that the energy train commences at the barrel or firing chamber 1 behind the projectile which is to be propelled, upon firing from the barrel by ignition of the charge of the cartridge and the generation by such ignition, of the propellant gases. The gas pressure from behind the projectile is tapped at 6 and is fed by a gas passage 7 to the input side or port 8 of a cylinder/gas-piston unit 2, the gas piston of which has not been illustrated in FIG. 1. The output 9 of the gas piston is effective upon the stepping ratchet 3 which is coupled with the input 10 of an energy-storage device 4 which, as described for the prior art previously, can be constituted by a stack or set of springs, the restoring movement of the ratchet level 3 being effected by a spring as well.

The energy-storage device 4 effectively has an output 11 which is coupled with input 12 of a transport device 5, e.g. an advancing shaft.

Upon firing of a round from the chamber, the propellant gases generate pressure behind the projectile and part of the volume of the propellant gas in a highly energetic form is branched through the passage 7 to the input side 8. This branched gas-pressure energy can be represented by $E_g$ and is thus applied to one side of the gas piston to initiate a predetermined working stroke thereof.

The gas-pressure energy is transformed thereby into mechanical energy $E_m$.

Because the gas pressure rise time within the chamber, upon firing, is only of the order of milliseconds, the gas pressure energy $E_g$ is only available for a corresponding time period and is applied in a pulse to the gas piston.

This pulse actuates the ratchet pawl 30 against the restoring spring thereof and transfers the mechanical energy $E_m$ to the input 10 of the force-storing spring system 4 to transform its mechanical (kinetic) energy $E_m$ to mechanical energy (potential+kinetic) $E_m'$ which appears at the output 11 of the energy-storage device 4 and is applied to the input 12 of the transport device 5.

The energy-storage device 4 thus functions as a delay device which, because it is mechanically coupled to the ratchet pawl 3, permits the brief energy $E_g$ to be applied over a longer period as the mechanical energy $E_m'$. Devices of this type are very complex and expensive as has been noted below.

Figure 2:
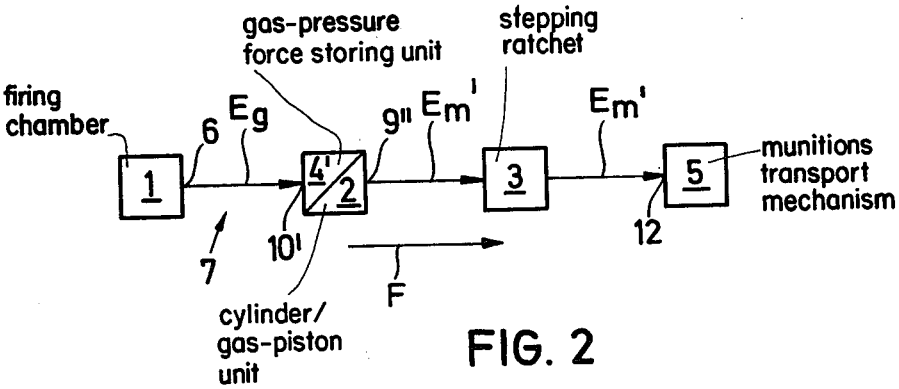
FIG. 2 is a diagram similar to FIG. 1 but illustrating the energy-flow path in the system of the present invention.

The energy-flow train according to the invention has been shown in FIG. 2 in the same form as FIG. 1. It can be seen from this Figure that the energy-storage unit 4' is not located behind the ratchet pawl 3, but rather is integrated with cylinder/gas-piston unit 2 and is provided ahead of the ratchet pawl 3 so that the gas-piston unit itself is displaced over a desired time span. The output side 9'' of the gas piston thus applies the mechanical energy $E_m'$ to the spring-loaded ratchet pawl 3 which, in turn, transfers this energy to the transport device 5 via the input 12 thereof. The result is a marked simplification in the system, reduced wear and requiring fewer moving parts which require maintenance or repair.

Figure 3:
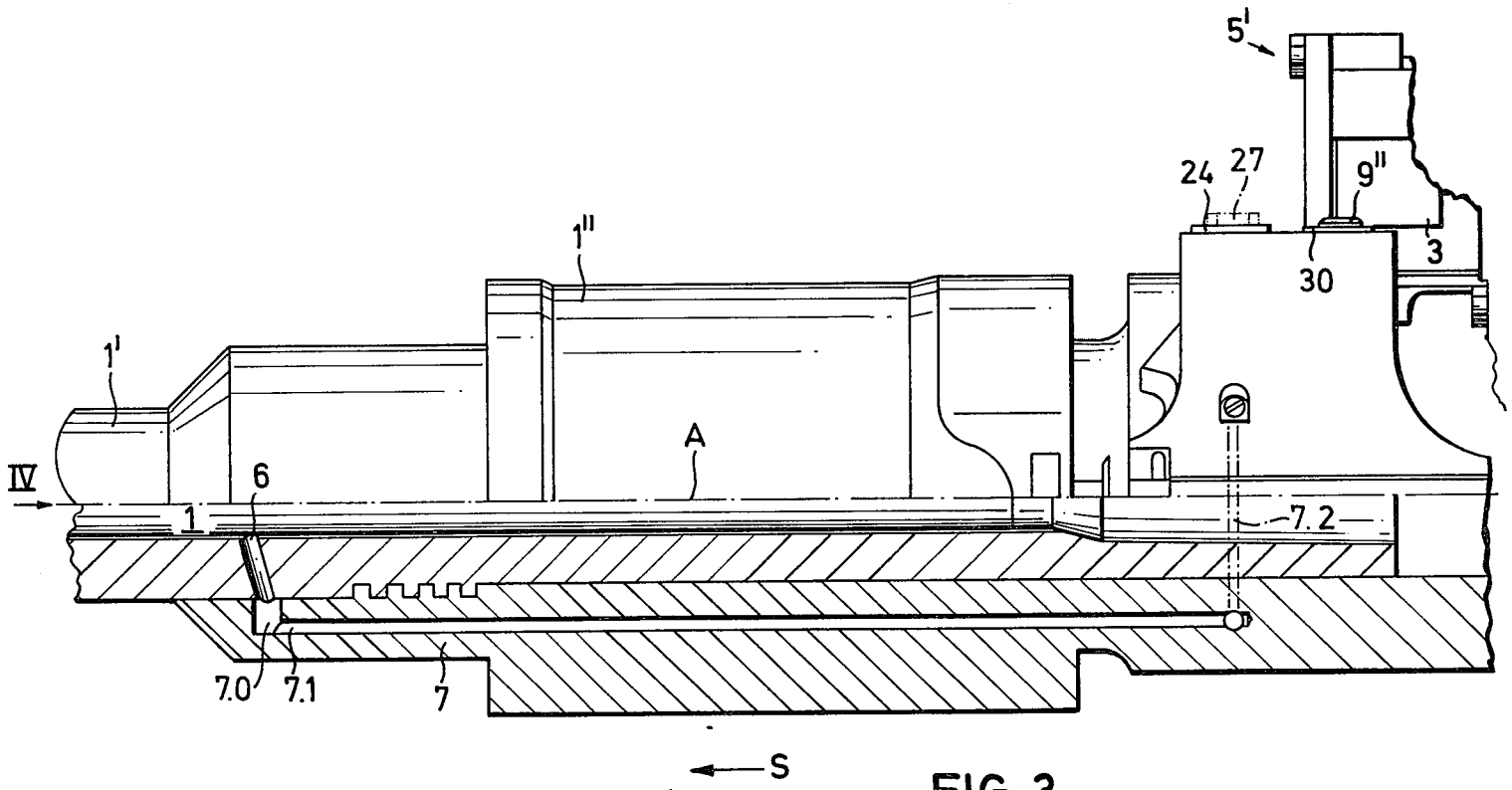
FIG. 3 is an elevational view of the firing chamber region of an automatic weapon, in accordance with the present invention, partly broken away along an axial cross section and partly in diagrammatic form.
Figure 4:
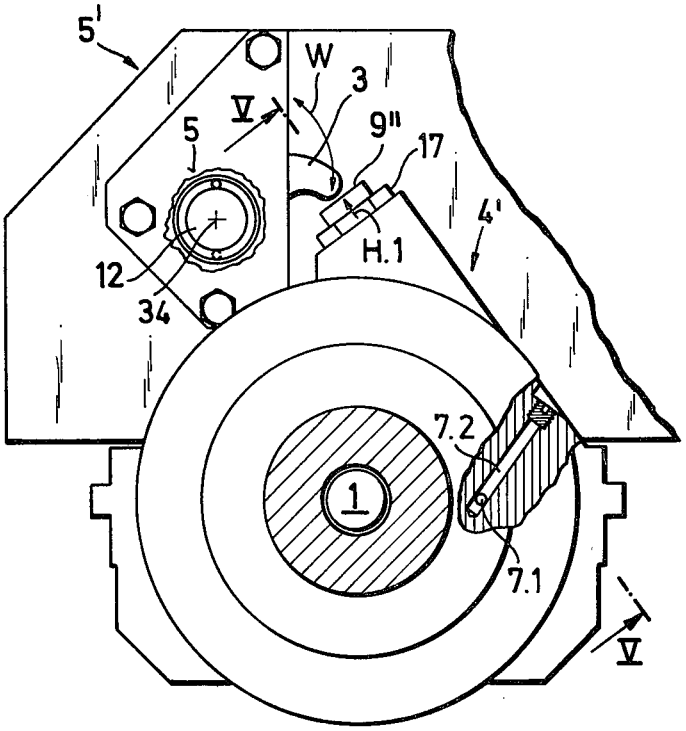
FIG. 4 is an end view in the direction of arrow IV of FIG. 3, also showing parts broken away.
Figure 5:
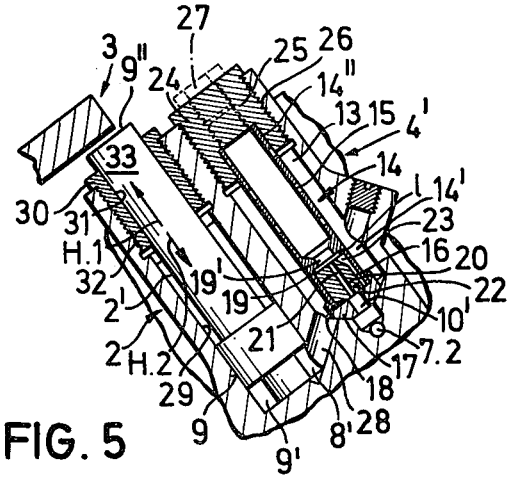
FIG. 5 is a cross-sectional view taken generally along the line V—V of FIG. 4.

The markedly reduced number of moving parts required for the claimed system will be readily apparent from FIGS. 3–5 and the following description thereof.

In FIG. 3 we have shown a portion of an automatic weapon in which only the parts essential to the invention have been illustrated in detail, the remaining portions being of the type generally described in said German patent and the literature cited therein including German Pat. No. 1,126,282 and U.S. Pat. Nos. 2,501,143 and 2,815,699 to the extent that such elements are consistent with the structure described hereinafter.

The weapon comprises the usual barrel 1' and a gun housing 1'' aligned with the barrel 1'. The interior of the barrel and the chamber is represented by the reference numeral 1, previously indicated to identify the pressurizable space behind the projectile (see FIG. 2) with which a propellant-gas tap 6 in the form of a passage communicates.

The passage 6, in turn, opens into an enlargement 7.0 of a gas passage in the housing. The gas passage 7 comprises a first branch 7.1 extending in the housing parallel to the axis A of the weapon and connected to a transverse branch 7.2 which is perpendicular to the axis A and opens into a gas reservoir or compartment 13 at the inlet 10'.

The inlet 10' is surrounded by a centering body 17 forming a seating surface 18 for a tubular insert 14. The insert 14 is provided with an inlet region 14' with a circularly cylindrical recess 16 which communicates with an orifice 19' formed in an abutment shoulder 19 in the insert 14 which is perforated at 15 to communicate between the outer partition of the space 13 and the interior of this tubular insert.

An end 14'' of the insert 14 is press-fitted into a central recess 25 of a plug 24 threaded into the housing 1'' of the weapon by a screw thread 26.

The cylindrical recess 16 receives a valve body 20 which is shorter by the distance l than the distance between the surface 18 from the abutment 19.

The valve body 20 is formed with a central bypass whose flow cross section is smaller than that of the orifice 19' and with at least one peripheral recess 22. In parallel with the gas reservoir 13 of the energy-storage unit 4', the cylinder/gas-piston arrangement 2 is provided with a cylindrical wall 29 forming a guide for the gas piston 9.

The latter has a pressurizable side 9' and, at its opposite end, a guide portion 33 whose end face 9'' engages the ratchet pawl 3.

The guide cylinder 2' is closed at its end proximal to the ratchet pawl 3 by a tubular threaded plug 30 whose screw thread 32 is connected with the housing 1'' and whose interior forms a guide housing for the portion 33 of the piston 9.

A passage 28 opens into the cylindrical wall 29 and connects the gas reservoir 13 outwardly of the insert 14 with the portion 8' of the cylinder at the gas-pressurizable side 9' of the piston.

The latter is axially shiftable in a working stroke in the direction of the arrow H.1, the restoring stroke being represented by the opposite arrow H.2.

The end face 9'' is juxtaposed with a surface of the pawl 3 mentioned previously which is swingable as represented by the arrow W about an axis indicated at 34.

The axis 34 is the axis of the stepping transport mechanism 5, e.g. its feed shaft, for the munitions belt of the weapon (see German Pat. No. 1,292,455), the pawl 3 being urged in the clockwise sense by a restoring spring (not shown). The belt-advance mechanism is received in a housing 5' and is not further illustrated.

The belt-feed system of the invention operates as follows:

When a cartridge in the chamber of the weapon is fired, the propellant gas develops in a period of the order of milliseconds a considerable pressure behind the projectile which is driven from the barrel in the direction of the arrow S (FIG. 3).

As soon as the projectile has passed the tap 6, for a brief period the propellant-gas pressure is applied through the passage 7 and a portion of the volume of this highly compressed propellant gas is led via the passage 7 to the inlet region 10' of the energy-storage unit. The pressure upstream of the energy-storage unit, i.e. at the inlet 10', is represented by $p_v$ and over the aforementioned interval is significantly higher than the pressure $p_h$ downstream of the inlet 10'.

The pressure gradient or differential is effective to drive the valve body 20 practically instantaneously against the abutment shoulder 19 so that the propellant gas passes through the bypass 21 and the passage 23 defined by the recess 22 into the gas reservoir 13. A ratio $a=p_v/p_h$ thus rapidly reahes the value of unity.

As soon as the projectile has left the barrel, the pressure in space 1 (hence the pressure $p_v$ ahead of the inlet region 10') drops rapidly to the atmospheric starting pressure. As a result of this reversal of the pressure gradient, the valve body 20 is displaced in the opposite direction of the distance l against its seat 18 so that only throttled flow of propellant gas through the bypass 21 is permitted. The reciprocal 1/a reaches unity more slowly.

The propellant gas which has been admitted to the reservoir 13 upon the development of the feed-pressure gradient favoring pressurization of the reservoir expands in the compartment 8' and shifts the gas piston 9 in the direction of its working stroke H.1. The end face 9'' of the piston swings the ratchet pawl 3 along the arc W about its axis 34 to advance the cartridge-carrying belt in the usual manner. During the working stroke, a form-fitting connection is ensured between the pawl 3 and the input element 12 of the transport device 5 which can be the feed shaft mentioned previously.

With each working stroke W of the ratchet pawl 3, the munitions belt is stepped through a full increment of its displacement to position the next cartridge at the chamber. The form-fitting connection between the pawl 3 and the shaft is then interrupted and the pawl swings in the opposite sense (clockwise in FIG. 4) into its starting position, as shown, to shift the piston 9 in the direction of its return stroke H.2.

The flow cross sections at 10' for pressurization and depressurization of the chamber 13 can be set optimally for the desired response rate of the munitions-belt feed. The timing is controlled by the conditions at the reservoir while the pneumatic energy is transformed simultaneously to mechanical energy at the mechanism 5, 12, 5'. The energy/time characteristic is selected in accordance with the firing characteristics of the weapon and thus as a function of the munitions used. However, the adjustment of the characteristic is relatively simple since the capacity of the energy-storage unit 4' can be advantageously modified in a simple manner.

The capacity of the gas-storage volume, apart from that of the passage 7 which can remain fixed, is controlled by the plug 27 which can be threaded into the plug 24 and which has been shown in dot-dash lines in FIG. 5. Naturally, other (measuring) means may be provided to indicate the effective volume of the compartment and to adjust it by effectively enlarging or decreasing the free space therein. The dimension l is adjusted by the plug 24.

We claim:

1. In a belt-advance system for a belt-feed gas-loading weapon having a munitions-belt advancing mechanism including an actuator element shiftable to step the munitions belt, means for tapping a portion of propellant gas from the weapon upon the firing thereof in the form of gas energy for actuating said element, a cylinder/gas-piston unit connection to said means for transforming gas energy into mechanical energy for actuation of said element by said mechanical energy, and an energy-storage unit capable of storing energy tapped from the weapon and forming a timer for the operation of said mechanism, the improvement wherein said units are functionally integrated and said energy-storage unit stores the gas energy directly and is provided ahead of the cylinder/gas-piston unit in the direction of energy flow for operation of said mechanism, said units being provided side-by-side in a common housing, said energy-storage unit comprising a chamber formed in said housing and having an inlet, a passage connecting said chamber with the cylinder of said cylinder/gas-piston unit, and means at said inlet for controlling the flow cross section of said inlet so that with an increasing value of the pressure $p_v$ ahead of said inlet, the ratio $a=p_v/p_h$ reaches unity rapidly while, upon rapid fall of the value $p_v$, the reciprocal ratio 1/a reaches unity more slowly, $p_h$ being the pressure downstream of said inlet.

2. The improvement defined in claim 1 wherein the controlling means at said inlet is constructed and arranged to provide a major flow cross section into said chamber upon the development of a higher pressure upstream of said inlet than downstream thereof, and providing a smaller flow cross section upon the pressure downstream of said inlet exceeding the pressure upstream thereof.

3. The improvement defined in claim 2 wherein said controlling means includes a valve body at said inlet and a bypass of predetermined flow cross section forming the small cross section.

4. The improvement defined in claim 3 wherein said bypass is formed in said body.

5. The improvement defined in claim 4, further comprising means for varying the volume of said chamber.

6. The improvement defined in claim 2 wherein the volume of said energy-storage unit includes the volume of a passage connecting a tap for gas energy running from the barrel of the weapon to said chamber.

7. The improvement defined in claim 6, further comprising means for varying the volume of said energy-storage unit.

8. The improvement defined in claim 1 wherein said mechanism includes a ratchet pawl angularly displaceable by a piston of said cylinder/gas-piston unit through a working stroke, and a transport shaft, said ratchet pawl engaging said shaft in form-locking manner during the entire working stroke.

* * * * *